United States Patent [19]

Pilolla

[11] 4,156,297

[45] May 29, 1979

[54] SEWAGE TREATMENT APPARATUS

[75] Inventor: Joseph J. Pilolla, Elmhurst, Ill.

[73] Assignee: Sloan Valve Company, Franklin Park, Ill.

[21] Appl. No.: 842,245

[22] Filed: Oct. 14, 1977

[51] Int. Cl.[2] ..... E03D 9/10

[52] U.S. Cl. ..... 4/320; 4/319; 4/321; 210/152

[58] Field of Search ..... 4/320, 321, 319, 322, 4/323, 317, 318; 210/152, 138

[56] References Cited

U.S. PATENT DOCUMENTS

| | | | |
|---|---|---|---|
| 2,951,251 | 9/1960 | Belden | 4/321 X |
| 3,094,707 | 6/1963 | Fleming | 4/319 X |
| 3,275,550 | 9/1966 | Daubenspeck | 4/319 X |
| 3,713,177 | 1/1973 | Tufts et al. | 4/320 |
| 3,733,617 | 5/1973 | Bennett | 4/320 |
| 3,787,901 | 1/1974 | Wagner et al. | 4/320 |
| 3,933,636 | 1/1976 | Daniels | 4/111.2 X |
| 3,939,499 | 2/1976 | Roberts | 4/320 |
| 3,950,249 | 4/1976 | Eger et al. | 4/320 X |
| 3,956,126 | 5/1976 | Streebin et al. | 4/320 |
| 4,012,322 | 3/1977 | Saigh et al. | 4/320 |
| 4,013,557 | 3/1977 | Snodgrass et al. | 210/152 |

*Primary Examiner*—Henry K. Artis

*Attorney, Agent, or Firm*—Kinzer, Plyer, Dorn & McEachran

[57] ABSTRACT

A sewage treatment apparatus for use in a toilet room comprises a casing with an inlet for reception of sewage and a discharge outlet. There are means within a chamber in the casing for the chemical treatment and agitation of the sewage to reduce the sewage to a substantially sterile slurry. There is a series of valves within the casing to control the passage of the sewage after it has been treated to be directly discharged through the casing outlet, or optionally discharged to a connected, remotely located holding tank.

13 Claims, 5 Drawing Figures

SEWAGE TREATMENT APPARATUS

BACKGROUND OF THE INVENTION

In prior systems for treating sewage, particularly those relating to water conserving waste disposal means for railroad trains and mobile transportation units, the equipment usually consisted of elaborate mechanisms for grinding and/or treating the waste materials. These devices required many moving parts and elements subject to constant wear and breakage, and therefore repeated repair and replacement was necessary. The devices were costly to make and difficult to install and often did not adequately sterilize the waste material. Other systems employed compressed air in conjunction with a reduced quantity of water to accomplish the flushing of the waste material. These systems, however, were seriously hampered by the introduction of foreign objects such as combs, bottles, brushes, sanitary napkins, etc. into the toilet system. Often these objects would clog the discharge outlet and required the system to be disassembled and the objects removed before the system could be used.

SUMMARY OF THE INVENTION

The present invention relates to a sewage treatment apparatus for use on a railroad car or other mobile transportation unit for example, which renders sewage substantially sterile before allowing it to be discharged from the system.

A primary purpose of the present invention is a sewage treatment apparatus and method in which the sewage is held within a confined zone and simultaneously agitated and chemically treated.

A purpose of the present invention is a sewage treatment apparatus in which flushing of the system can be accomplished with limited amounts of water on the order of one quart.

A purpose of the present invention is a sewage treatment apparatus in which air pressure is introduced into the treatment zone to create a turbulence which, in cooperation with a plurality of teeth-like projections, is sufficient to agitate and break up the sewage.

A purpose of the present invention is a sewage treatment apparatus including a straight, relatively large open passage from the inlet to the outlet and valve means for automatically discharging foreign objects introduced into the system.

A purpose of the invention is a sewage treatment apparatus which may discharge the treated sewage directly to the ground where permissible or optionally discharge the sewage to a holding tank.

A purpose of the invention is a sewage treatment apparatus with a remotely located holding tank and a water sealed toilet bowl so that the user may be insulated from offensive odors.

A purpose of the invention is a sewage treatment apparatus with a holding tank whereby stored sewage may be automatically expelled.

Other purposes will appear in the ensuing specifications, drawings and claims.

BRIEF DESCRIPTION OF THE DRAWINGS

The invention is illustrated diagrammatically in the following drawings wherein.

DESCRIPTION OF THE PREFERRED EMBODIMENT

While the invention will be described in connection with a preferred embodiment and shown as though mounted on a railroad passenger car, it will be understood that it is not intended to limit the invention to that embodiment. On the contrary, it is intended to cover all alternatives, modifications and equivalents as may be included within the spirit and scope of the invention as defined by the appended claims.

Figures 1, 2:
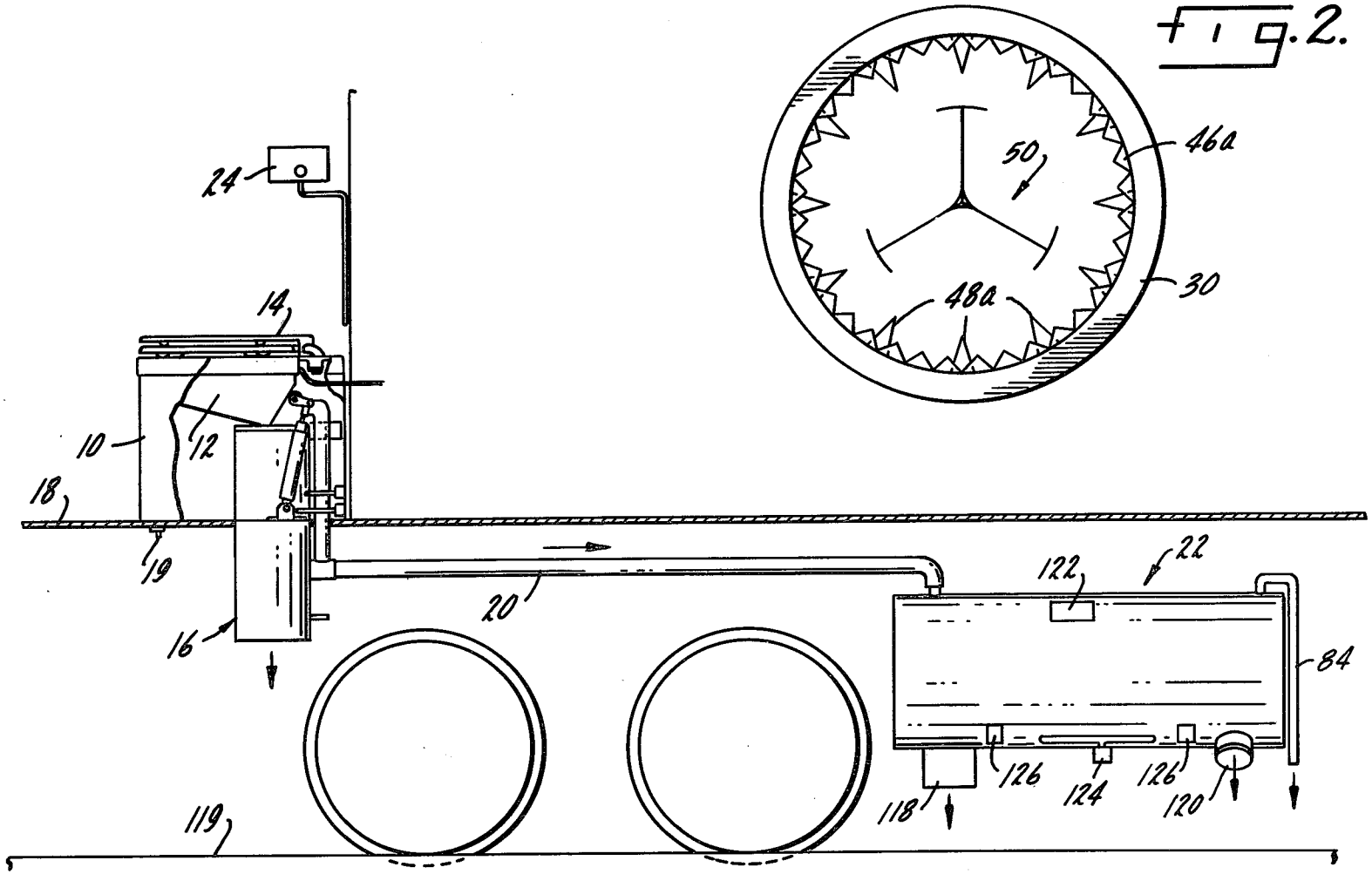
FIG. 1 is a diagrammatic illustration of the sewage treatment apparatus, toilet and holding tank, mounted to a railroad car.
FIG. 2 is a top view of the macerating rings and their teeth and shows the upper pinch valve in its closed position.

As shown in FIG. 1, a housing 10 supports a conventional hopper-type toilet 12, seat 14, and a sewage treatment apparatus 16. The system is secured to the floor 18 of a railroad car in the desired location, usually at one end of the car, by bolts 19. The sewage treatment apparatus 16 extends through concentric holes in the housing 10 and floor 18 to a position underneath the railroad car. A conduit 20 connected to the sewage treatment apparatus 16 leads to a remotely located holding tank shown generally at 22, which is secured underneath the floor 18 of the railroad car. An electrical switch 24 is mounted to the wall of the toilet room and is activated by the user to initiate the sewage treatment process.

Figure 3:
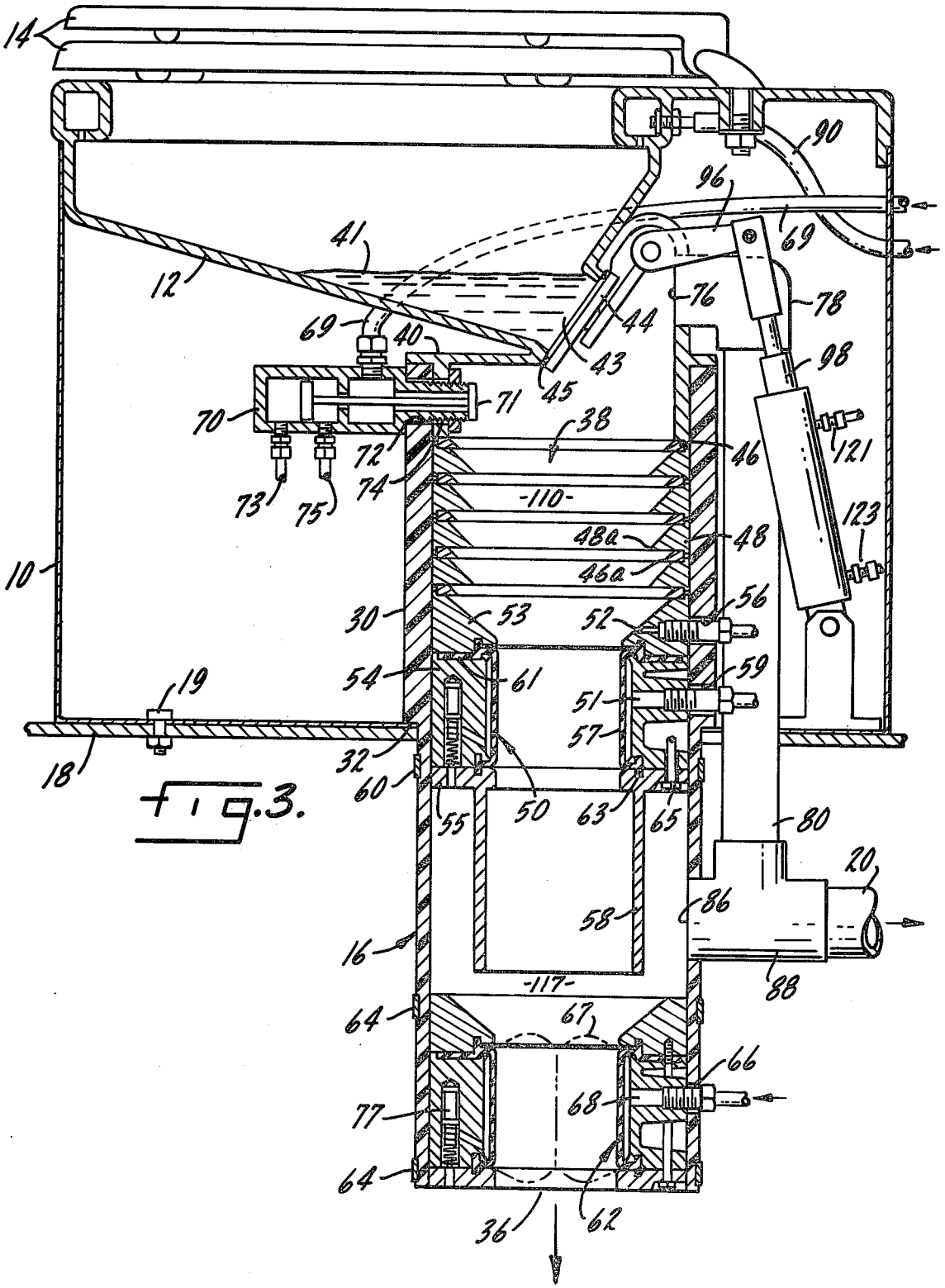
FIG. 3 is a partial sectional view of the sewage treatment apparatus and toilet bowl.

As shown in detail in FIG. 3, the sewage treatment apparatus 16 has a generally cylindrical polyurethane casing 30 supported on the housing floor 10 at shoulder 32. Casing 30 has an outlet 36 at its lower end and an inlet 38 at its top end. A cover 40 couples the casing 30 with toilet bowl opening 43 normally closed by flapper valve 44. A flexible annular seal 45 is carried by flap 44 and prevents the leakage of water 41 from bowl 12.

A plurality of alternately arranged annular rings 46, 48 of differing thickness and having alternate sized projections or serrations are positioned within the casing adjacent cover 40. Large projections **48*a* and smaller projections 46*a* are shown particularly in FIG. 2. Immediately below and supporting rings 46, 48 is a pinch valve assembly shown generally and in the open position at 50**.

The pinch valve assembly is similar to the pinch valve employed in U.S. Pat. No. 4,013,557, and also similar to that fully described in a U.S. patent application, Ser. No. 743,701, filed Nov. 22, 1976. The pinch valve therefore is described only briefly herein. The pinch valve assembly 50 comprises an annular top cap 53, housing 54 and lower ring 55. Positioned within housing 54 is a generally cylindrical, flexible, distortable rubber-like valve member 57, having upper and lower supporting flanges 61, 63 positioned within corresponding grooves in housing 54. The pinch valve components are fastened together by a plurality of bolts 65. A pair of air ports 51, 52 are in alignment with port openings 56, 59 in casing 30, and a cylindrical projection 58 extends from the bottom of lower ring 55. The upper pinch valve assembly 50 is inserted from the lower end of casing 30 and held in place by strap 60 which is tightened around casing 30 and exerts an inward pressure on lower ring 55. A second similar pinch valve shown generally at 62 is inserted in the bottom of casing 30 and secured therein at a position below projection 58 by straps 64. A port opening 66 in casing 30 aligns with air port 68.

The upper pinch valve 50 is shown in the open position. As pressurized air enters port 51, the valve member 57 will be caused to expand and seal in the closed position, which is shown by the dotted line 67 in lower pinch valve 62. As the air is released through port 51, or in the case of lower pinch valve 62, port 68, the valve member 57 will return to the open position. Poppet valve assembly 77 is used to vent any accumulated moisture which may occur in the supply of fluid pressure. For the details of the design of valve member 57 reference is had to the above mentioned patent and patent application.

Figure 4:
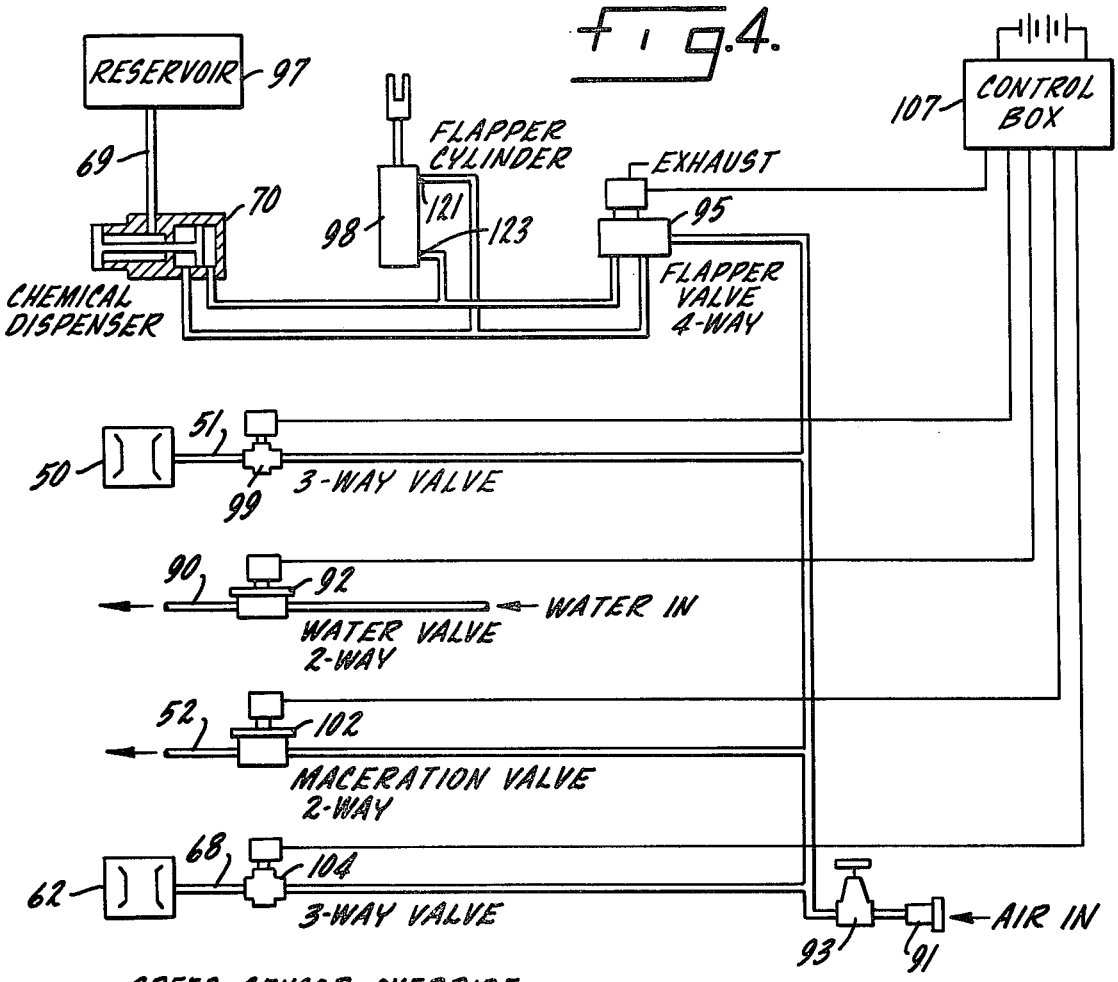
FIG. 4 is a schematic drawing of the control valves and their water or air and control box connections.

Vent opening 76 and attached elbow 78 leads to conduit 80, union 88, conduit 20 and then to holding tank air exhaust vent 84. Located in the casing 30, between pinch valves 50 and 62, is opening 86 providing a sewage passageway to holding tank 22 through conduit 20. A chemical dispenser 70 is mounted perpendicular to the wall at the top of casing 30, and protrudes inward through casing opening 72 and cover opening 74. A chemical reservoir 97, shown schematically in FIG. 4, is connected to dispenser 70 by means of plastic tubing 69. Plunger 71 may move from a closed to an open position allowing communication by gravity of the fluid in chemical reservoir 97 with the interior of sewage treatment apparatus 16. The movement of plunger 71 is controlled by air pressure entering either port 73 or port 75 which respectively open or close dispenser 70.

A water supply line 90 furnishes flushing water to toilet bowl 12 and, as can be seen in FIG. 4, is electrically controlled by two-way solenoid flush valve 92. A supply of fluid pressure is obtained from the vehicle at 91 and directed through a pressure regulator 93 to four pneumatic control valves 95, 99, 102 and 104. This fluid pressure may be in the form of compressed air, steam or any other fluid pressure, which is readily available on the vehicle. It will be assumed herein that compressed air is employed.

A normally closed flap valve 44, for controlling passage of the sewage from toilet 12 into sewage treatment apparatus 16, is mounted to the toilet bowl 12. Linkage 96 is journaled to air cylinder 98 allowing the movement of air cylinder 98 to open and close flap 44. The air pressure is supplied to cylinder 98 at air ports 121, 123. Four-way valve 95 electrically controls the movement of the air cylinder to the open and closed positions and simultaneously controls the injection of chemical from dispenser 70 into the sewage treatment apparatus. Three-way electrically controlled solenoid valve 99 controls the passage of air through port 51 to open or close upper pinch valve 50; and valve 104, identical to valve 99, controls the opening and closing of the lower pinch valve 62. Two-way solenoid valve 102 controls the passage of air through port 52.

The holding tank 22 is secured underneath the railroad car, preferably at a remote location. Appearing on tank 22 is an automatic dump valve 118, identical to lower pinch valve 62, as well as manually opened dump 120. A level sensing device 122 is provided on the upper periphery of tank 22. If tank 22 ever becomes filled to such a level, sensing device 22 will shut down the operation of the system until further action is taken. A heating element 124 and a thermostat 126 prevent the freezing of the sewage slurry when the system is used in colder climates.

DESCRIPTION OF THE OPERATION

A user of the toilet deposits sewage into bowl 12 which comes to rest against flap 44. The user initiates the sewage treatment process by closing wall switch 24 which activates a series of timers in control box 107. The electrical connections of control box 107 are shown in FIG. 4, however, the function of its controls are more clearly shown in FIG. 5. The initial function of control box 107 is to activate the upper pinch valve timer 106 causing the normally open pinch valve 50 to close. Shortly thereafter, a three-function timer 111 ultimately controlling flap 44, flush valve 92, and dispenser 97, begins its cycle. Timer 111 causes four-way valve 95 to simultaneously open flap 44 and also inject a predetermined amount of chemical from dispenser 70. At the same instant, timer 111 causes flush valve 92 to open and remain open for a predetermined period of time, allowing approximately one quart of water to flush the sewage and cleanse bowl 12. The prior closing of upper pinch valve 50 holds the mixture or batch of sewage, water and chemical, in the upper interior of casing 30 which becomes the treatment zone and macerating chamber 110. The termination of the three-function timer cycle results in the closing of flap valve 44, flush valve 92 and dispenser 70. This results in the trapping of any water which is swirling down the sides of bowl 12 at the time when flap 44 was closed. This small quantity of water 41 provides a water seal to prevent sewage odors from penetrating the toilet room environment.

The macerating timer 113 now opens macerating valve 102 to allow air under pressure to enter the macerating chamber 110 through port 52. During the macerating cycle a violent blending of air, water, chemical and sewage in the chamber 110 results in the physical breakup of the solid waste materials and a thorough chemical treatment. The teeth-like projections **46*a*; 48*a* of rings 46, 48 provide sharp surfaces to increase the turbulent agitation and the breaking up of the sewage during the macerating cycle, and aids in pulverizing any toilet tissue introduced into the system. Vent opening 76 and connected conduits 80,20 provide means to exhaust air through holding tank air exhaust 84. This prevents an excessive pressure buildup in chamber 110 during maceration, thus assuring safe operation. After a predetermined time the upper pinch valve closure cycle ends returning the upper pinch valve 52 to its open position. The sewage having been reduced to a substantial sterile slurry drops from the sewage treatment apparatus to the railroad tracks 119** below.

Figure 5:
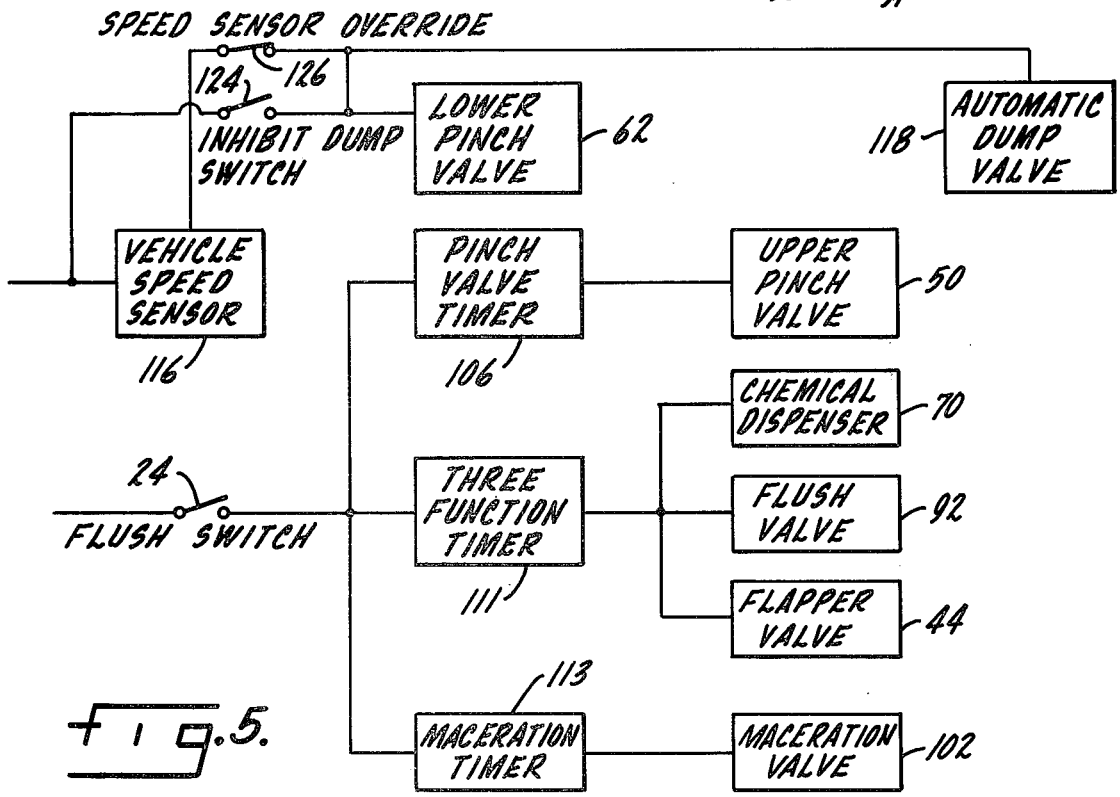
FIG. 5 is a block diagram of the electric controls.

At times it is inappropriate or impermissible to directly drop the treated slurry to the railway tracks. This will occur in populated areas where the train must travel at lower speeds or is stopped in a station. A vehicle speed sensor 116 therefore is provided as shown in FIG. 5 to close the lower pinch valve 62 as well as the automatic dump valve 118 in holding tank 22.

The operation of the system with the lower pinch valve 62 closed by the speed sensing device 116 is similar to the operation described above. Now, however, with the blockage of the direct passage through the sewage treatment apparatus 16 to the tracks, an intercept chamber 117 is formed above the lower pinch valve 62. The slurry is pumped under pressure from chamber 117 through opening 86 and conduit 20 to holding tank 22. The air pressure forcing this movement is the result of continuation of the macerating cycle for a fixed period of time after the upper pinch valve has been opened. This final period may more descriptively be labeled the pump-out cycle, since once upper pinch valve 50 is opened, any maceration which may occur is merely incidental to the pump-out function. However, it should be noted that there is no interruption in the supply of air under pressure between the macerating and pump-out cycles and the pressurized air for both cycles is supplied through port 52.

Each of the timers may have predetermined time periods during which they will hold their respective valves in an open position. Normally these time periods may vary without affecting the efficiency of the system; however, a specific time schedule which has been found to result in highly efficient operation is noted below. With the user's activation of wall switch 24 taken as the zero reference point, the start and finish of the various cycles are as follows:

Upper pinch valve closure cycle—0 and 160 seconds;
Flap valve open, flush and chemical injection cycle—4 and 9 seconds;
Macerating cycle—9 and 160 seconds; and
Pump-out cycle—160 and 180 seconds.

It can be seen that the straight through design of casing 30 prevents the clogging of the system by the introduction of foreign objects into the system. By the carelessness of a user, or the design of vandals, objects such as combs, brushes, bottles, towels, etc., not infrequently find their way into toilet bowl 12. In the operation of the system these objects fall to a position above upper pinch valve 50 and remain there during the macerating cycle. At the termination of the macerating cycle, upper pinch valve 50 opens and these objects are expelled from outlet 36 to the railroad tracks. It is noted that since the diameter of pinch valves 50, 62 is greater than cover opening 43, objects which enter from this opening are small enough to easily pass through the sewage treatment apparatus 16.

It is recalled that at lower speeds, the vehicle speed sensing device 116 closes lower pinch valve 62 causing the treated sewage to be expelled through conduit 20 to the holding tank 22. In such an instance, projection 58 extending past opening 86 prevents a foreign object from lodging against opening 86 or entering and clogging conduit 20. Once the train reaches a higher speed, sensor 116 opens lower pinch valve 62 and the foreign objects will exit from casing 30.

On rare occasions the particular shape of the foreign object may cause it to lodge within casing 30. Such an occurrence will not prevent successful operation of the system even if the object lodges at a position adjacent to the pinch valves 50, 62. The high flexibility and expandability of pinch valve sealing member 57 allows it to close and tightly seal despite an object being located within its closure path. The foreign object eventually may dislodge and fall to the railway tracks or may remain lodged within casing 30 indefinitely without affecting the apparatus' operation.

As discussed previously, the speed sensor 116 will normally prevent dumping when the vehicle is traveling at a rate lower than a preselected speed. Under certain conditions, such as high speeds while traveling over A water shed area, it may be desired that no dumping of sewage take place regardless of the vehicle speed. An inhibit dump switch 124, therefore, is provided to allow continuous closing of lower pinch valve 62 and automatic dump valve 118 to prevent any dumping.

Conversely, it may be desired to allow dumping even when the vehicle is traveling at lower speeds or is stopped by overriding the vehicle speed sensor. It is noted valves 62 and 118 are normally in the open position, but closed by an electrical signal from sensor 116 at lower speeds. Therefore, speed sensor override switch 126 is provided and when opened prevents the closing signal from sensor 116 from reaching the normally open lower pinch valve 62 and automatic dump valve 118.

As a modification conduit 20 may be connected through casing 30 directly to macerating chamber 110, and include a valve to control the passage of treated sewage to holding tank 22. In such an arrangement an intercept chamber 117 and a lower pinch valve 62 would not be required.

It can be seen that the apparatus is a reliable and effective means of treating sewage. The straight-through design prevents any clogging of the system and the reduced amount of moving parts limits the possibility of other breakdowns. The minimal water requirements of only one quart per flush, which is made possible by the air maceration feature, aids water conservation efforts. Finally, the optional storage of the treated sewage in the holding tank, along with the vehicle speed sensor, insures ecological protection of the environment.

The embodiments of the invention in which an exclusive property or privilege is claimed are defined as follows:

1. A sewage treatment apparatus comprising a hollow, elongated casing having an inlet for reception of sewage, a discharge opening and a discharge outlet, a macerating chamber in said casing, an intercepting chamber in said casing located below said macerating chamber for intercepting the passage of said sewage through said discharge outlet and causing said sewage to pass through said discharge opening, a valve means located between said macerating chamber and said intercepting chamber, means for closing said valve means to temporarily hold a batch of sewage in said macerating chamber, means for macerating the sewage as it is held in said macerating chamber, means for opening said valve means to deposit the sewage from said macerating chamber into said intercepting chamber, a second valve means at the outlet of said casing and below said intercepting chamber, means for opening said second valve means to discharge the sewage from the discharge outlet of said casing, a holding tank connected to said discharge opening and means for optionally transferring said sewage through said discharge opening to said holding tank or through said discharge outlet.

2. The sewage treatment apparatus as claimed in claim 1 in which a chemical dispenser is attached to said casing and has a chemical discharge outlet communicating with said macerating chamber, and means for discharging the chemical into said macerating chamber during the time the sewage is being macerated in said macerating chamber.

3. The sewage treatment apparatus as claimed in claim 1 in which said macerating chamber has a series of serrations arranged around the inside diameter of said macerating chamber, and means for introducing a fluid pressure into said macerating chamber to create turbulence and agitation in said sewage and to force said sewage into engagement with said serrations to reduce said sewage to a slurry.

4. In a waste disposal apparatus for a water closet having a toilet bowl and a normally closed flapper valve at the outlet of said bowl, an elongated tubular casing attached to the outlet end of said bowl and extending vertically downward therefrom, a macerating chamber formed in said casing below said bowl, a flexible pinch valve inside said casing below said macerating chamber for controlling the outlet from said macerating chamber, an intercepting chamber below said pinch valve, said casing having a discharge outlet and a discharge opening in communication with said intercepting chamber, a second pinch valve below said intercepting chamber for controlling the discharge from said casing outlet, a holding tank connected to said discharge opening, means for admitting flushing water into said bowl, means for closing said first pinch valve, means for opening said flapper valve to discharge water and waste matter into said macerating chamber, means for injecting a chemical into said macerating chamber to kill bacteria in said contained waste matter, means for injecting air pressure into said macerating chamber to cause the waste matter to be agitated and swirled into a slurry in said chamber, means for opening said first pinch valve to expel the waste matter into said intercepting chamber assisted by the air pressure in said chamber, means for opening said second pinch valve to discharge the waste material from the outlet of said casing, and means for closing said second pinch valve to optionally discharge said waste material out said discharge opening to said holding tank.

5. The sewage treatment apparatus as claimed in claim 4 in which said first and second valve means are normally open, and a speed sensing device for closing said second valve means when the vehicle speed is less than a predetermined velocity.

6. The sewage treatment apparatus as claimed in claim 1 in which a bypass connection extends from the macerating chamber to the intercepting chamber for the purpose of equalizing the fluid pressure in the macerating chamber and the outlet.

7. In a sewage treatment apparatus comprising an elongated casing having an inlet for the reception of sewage, a discharge opening and a discharge outlet, a macerating chamber adjacent the inlet end of said casing, an intercepting chamber adjacent the outlet end of said casing for intercepting the passage of said sewage through said discharge outlet and causing said sewage to pass through said discharge opening, a flexible first valve means in said casing at the bottom of said macerating chamber, a second flexible valve means at the bottom of said intercepting chamber, said intercepting chamber being located between said two valve means, means for introducing air pressure against said first valve means to close the same, means for introducing air pressure into said macerating chamber to cause agitating and turbulence of deposited sewage held in said macerating chamber, means for closing said second valve means and for opening said first valve means to deposit the treated sewage in said intercepting chamber, a holding tank and a conduit connection between said holding tank and said discharge opening, and means controlling said second valve means for optionally passing the sewage through the conduit connection to said holding tank by said air pressure when the second valve means is closed or through the outlet of said casing when the second valve means is open.

8. The sewage treatment apparatus as claimed in claim 7 in which air pressure assists in forcing the sewage from said macerating chamber and said intercepting chamber into said conduit connection to the storage tank when said second valve means is in closed position.

9. The sewage treatment apparatus as claimed in claim 7 in which a projecting member inside said casing spaced from the inner walls of said casing is located between said first valve member and said second valve member, said projecting member extending below the connection of said conduit connection with said intercepting chamber.

10. The sewage treatment apparatus as claimed in claim 7 in which there is a chemical dispenser connected to said macerating chamber for dispensing a sterilizing liquid into said macerating chamber in order to sterilize the sewage.

11. The sewage treatment apparatus as claimed in claim 7 in which the deposited sewage passes into said macerating chamber, through said first valve means and into said intercepting chamber by gravity assisted by air pressure from said macerating chamber, said sewage passing through said conduit connection to said storage tank by means of said air pressure.

12. The sewage treatment apparatus as claimed in claim 8 in which the second valve member is located in the outlet end of said casing and said projecting member extends below the connection of said connecting conduit and above said second valve member, said second valve member in its closed position diverting the sewage into said conduit connecting around the end of said projecting member, and in its open position passing the sewage and foreign objects into the outlet end of said casing, said projecting member preventing the passage of foreign objects into said conduit connection.

13. The waste disposal apparatus as claimed in claim 3 in which said series of annular disposed serrations arranged around the internal diameter of said casing are further characterized by said serrations being composed of long and short teeth projecting inward of said macerating chamber upon which the waste matter is impinged to reduce the size of the particles.

* * * * *